US006733723B2

(12) United States Patent
Choi et al.

(10) Patent No.: US 6,733,723 B2
(45) Date of Patent: May 11, 2004

(54) METHOD FOR PRODUCING SINTERED METAL AND A ROTARY COMPRESSOR FLANGE PRODUCED BY USE OF THE METHOD

(75) Inventors: Dong-Jun Choi, Suwon (KR); Sie-Hyeong Kim, Yongin (KR); Sung-Gyun Lim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/160,114

(22) Filed: Jun. 4, 2002

(65) Prior Publication Data

US 2003/0138341 A1 Jul. 24, 2003

(30) Foreign Application Priority Data

Jan. 22, 2002 (KR) ..... 2002-3548

(51) Int. Cl.[7] ..... B22F 3/24
(52) U.S. Cl. ..... 419/26; 419/29
(58) Field of Search ..... 419/29, 25, 55, 419/26

(56) References Cited

U.S. PATENT DOCUMENTS 5,169,459 A * 12/1992 Fukushima et al. ..... 148/325
5,562,786 A * 10/1996 Hayashi et al. ..... 148/579
6,302,937 B1 * 10/2001 Hayashi et al. ..... 75/231

FOREIGN PATENT DOCUMENTS

JP 7039104 A * 3/1982 ..... B22F/3/24
JP 357070262 A * 4/1982 ..... C22C/38/40
JP 363195202 A * 8/1988 ..... B22F/3/24
JP 406033184 A * 2/1994 ..... C22C/33/02
JP 406033185 A * 2/1994 ..... C22C/33/02
JP 363143208 A * 6/1998 ..... B22F/3/24

* cited by examiner

*Primary Examiner*—Daniel Jenkins
(74) *Attorney, Agent, or Firm*—Staas & Halsey LLP

(57) ABSTRACT

A method to produce a sintered metal with an improved abrasion resistance and durability, and a rotary compressor flange produced by use of the method. The sintered metal is produced by kneading metal powder, pressure molding the kneaded powder, and sintering the molded powder. The sintered metal is further produced by subzero treating the sintered metal powder for a predetermined time and tempering the resulting sintered metal powder under a predetermined compression residual stress.

13 Claims, 6 Drawing Sheets

METHOD FOR PRODUCING SINTERED METAL AND A ROTARY COMPRESSOR FLANGE PRODUCED BY USE OF THE METHOD

CROSS-REFERENCE TO RELATED APPLICATIONS

This application claims the benefit of Korean Application No. 2002-3548, filed Jan. 22, 2002, in the Korean Industrial Property Office, the disclosure of which is incorporated herein by reference.

BACKGROUND OF THE INVENTION

1. Field of the Invention

The present invention relates to a method to produce a sintered metal with a high abrasion resistance and durability, and a rotary compressor flange produced by use of the method.

2. Description of the Prior Art

A conventional rotary compressor used to compress coolant of a cooling system includes a stator 2 fixed in a sealed vessel 1 and a driving part 4 having a rotor 3 rotatably set in the stator 2. A compressing part 5 is set in a lower section of the sealed vessel 1 to compress the coolant by a rotating force produced by the driving part 4 (see FIG. 1).

The compressing part 5 includes a rotary shaft 6, which is concentrically combined with the rotor 3, extended to the compressing part 5, and has an eccentric rotor 6*a* with a predetermined length. A cylinder 7 is set in the compressing part 5 to accept the eccentric rotor 6*a* of the rotary shaft 6. Two flanges 8 and 9 are mounted to upper and lower ends, respectively, of the cylinder 7, and rotationally support the rotary shaft 6. Furthermore, the compressing part 5 includes a roller 10 rotatably fitted around the eccentric rotor 6*a* such that the roller 10 rotates and revolves while being in contact with an inner surface of the cylinder 7 when the eccentric rotor 6*a* is rotated. A vane (not shown) is set in the cylinder 7 and comes into contact with an outer surface of the roller 10. A part above the vane is advanced and retreated in a radial direction of the roller 10 so that an interior of the cylinder 7 is divided into two variable chambers (e.g., a low pressure chamber and a high pressure chamber).

In the conventional rotary compressor, when the eccentric rotor 6*a* is rotated in the cylinder 7 by a rotating force of the rotor 3, the roller 10 rotates and revolves in contact with the inner surface of the cylinder 7, and the coolant is sucked into the cylinder 7 and compressed while the vane is advanced and retreated in the radial direction of the roller 10. In other words, a low temperature and low pressure coolant flowing into the cylinder 7 through a suction port 12 is compressed and discharged from the cylinder 7 through an outlet port 13 of the upper flange 8.

However, this conventional rotary compressor has disadvantages in that surfaces of the flanges 8 and 9 used for a lengthy period of time are worn because significant friction occurs at contact surfaces between the flanges 8 and 9, the rotary shaft 6, the eccentric rotor 6*a*, and the roller 10 while the coolant is compressed. Metal powder produced from the flanges 8 and 9 resolves the coolant, and materials produced by resolving of the coolant cause metal parts of the rotary compressor to be eroded and corroded to produce sludge. Consequently, a smooth operation of the rotary compressor is impeded.

SUMMARY OF THE INVENTION

Accordingly, it is an object of the present invention to provide a method to produce a sintered metal with an improved abrasion resistance and durability to endure significant friction, and a rotary compressor flange produced by the method.

Additional objects and advantages of the invention will be set forth in part in the description which follows and, in part, will be obvious from the description, or may be learned by practice of the invention.

The foregoing and other objects of the present invention are achieved by providing a method to produce a sintered metal including kneading metal powder and pressure molding the kneaded powder, sintering the metal powder, subzero treating the sintered metal powder for a predetermined time, and tempering the resulting sintered metal powder under a predetermined compression residual stress.

According to an aspect of the invention, the metal powder includes carbon powder (C) of 0.2 to 0.8 wt %, copper powder (Cu) of 0.5 to 4.0 wt %, nickel powder (Ni) of 1.0 wt % or less, and iron (Fe) powder as a main component.

According to an aspect of the invention, the subzero treating is conducted at −196 to −200° C.

According to an aspect of the invention, the subzero treating is conducted for 30 minutes.

According to an aspect of the invention, the tempering step is conducted at 100 to 120° C.

BRIEF DESCRIPTION OF THE DRAWINGS

The above and other objects, features and advantages of the present invention will become apparent and more appreciated from the following detailed description of the preferred embodiment, taken in conjunction with the accompanying drawings of which.

DETAILED DESCRIPTION OF THE PREFERRED EMBODIMENTS

Figure 1:
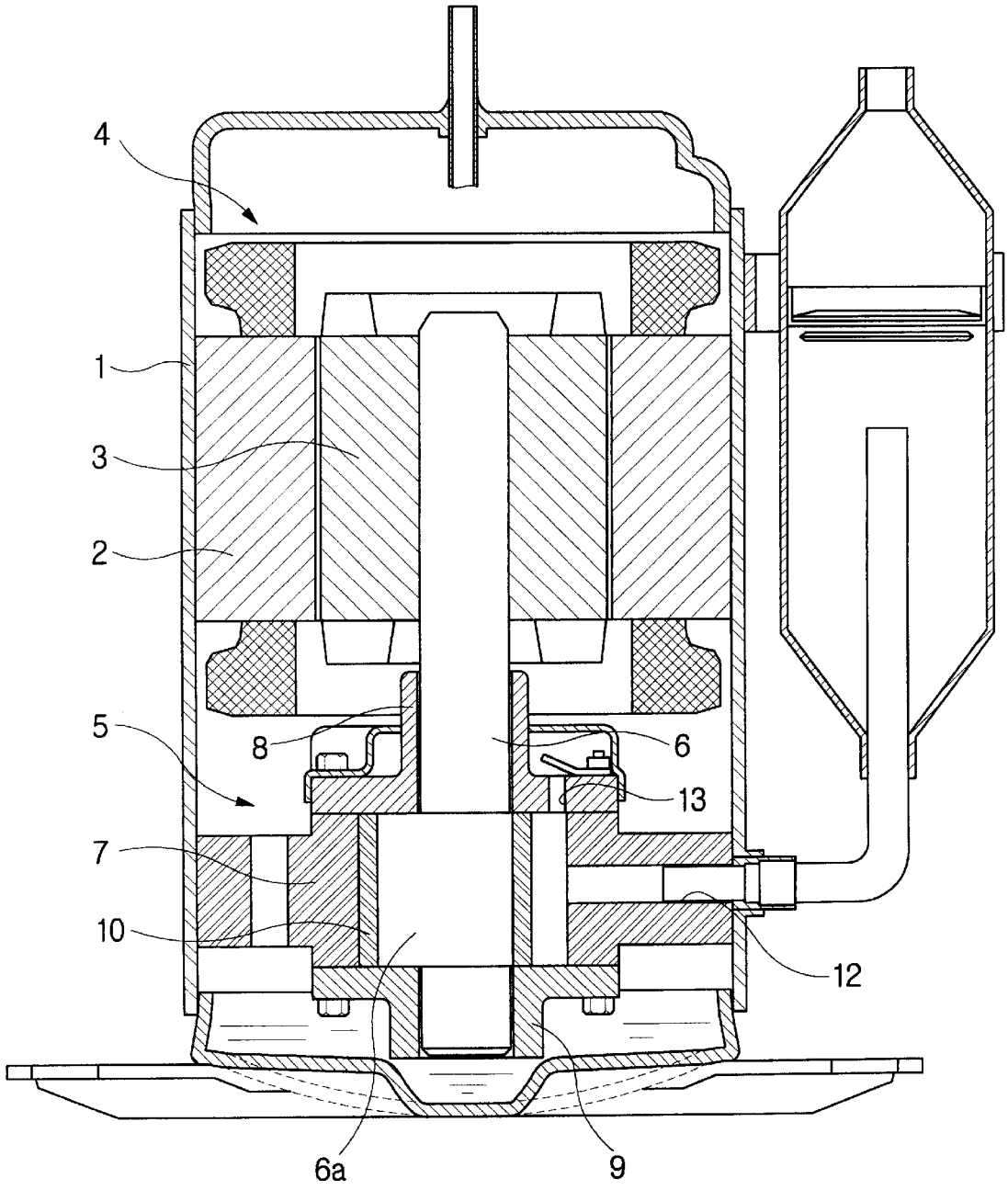
FIG. 1 (PRIOR ART)
FIG. 1 is a sectional view of a conventional rotary compressor.

Reference will now be made in detail to the present preferred embodiment of the present invention, examples of which are illustrated in the accompanying drawings, wherein like reference numerals refer to like elements throughout.

Figure 2:
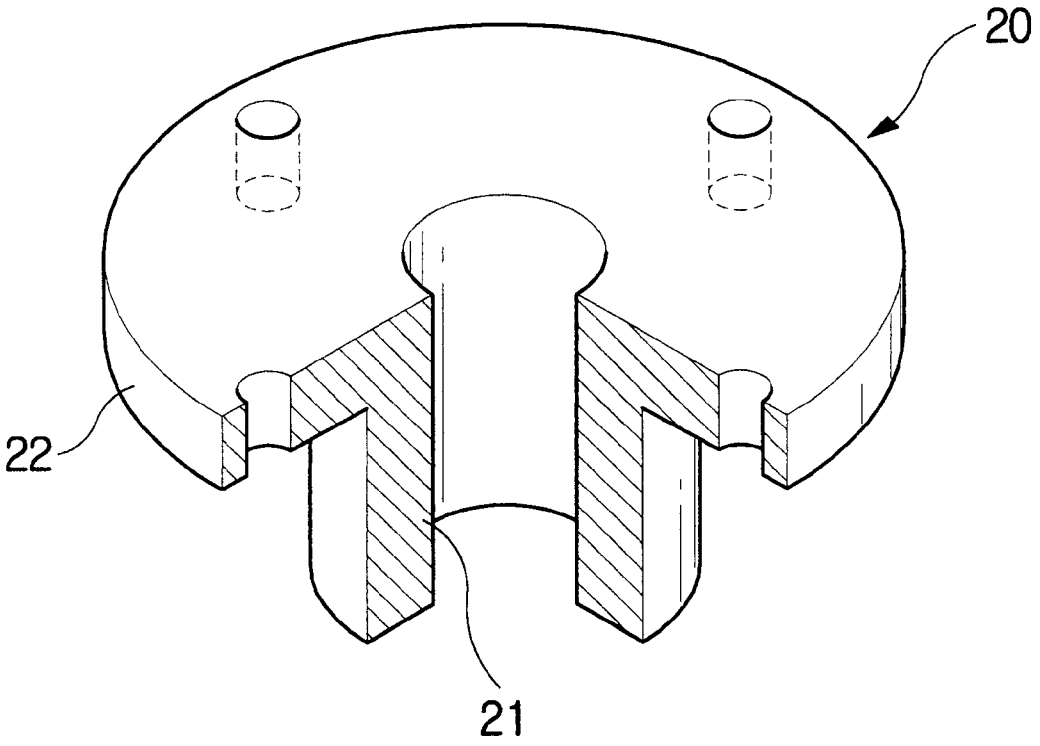
FIG. 2 is a perspective view of a rotary compressor flange, according to an embodiment of the present invention.
Figure 3:
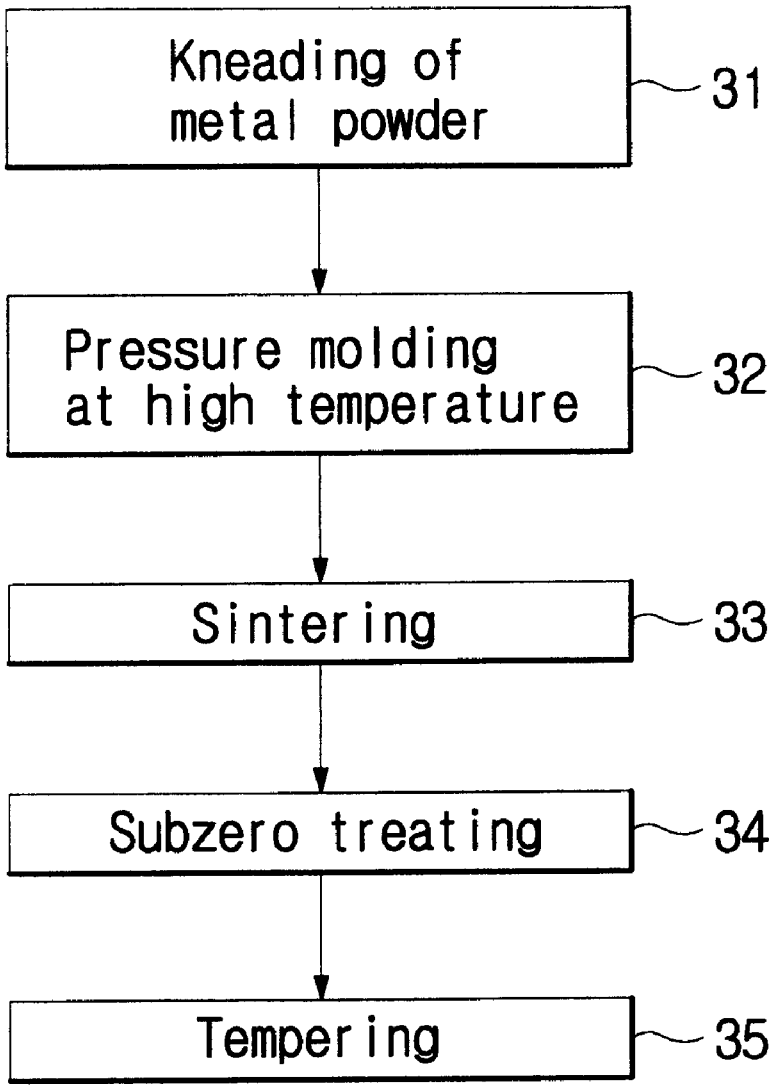
FIG. 3 is a flow chart illustrating a method of production of a sintered metal, according to an embodiment of the present invention.

As shown in FIG. 2, a rotary compressor flange 20 includes a shaft combined part 21, which is combined with a rotational shaft of a rotary compressor, and a flange part 22 combined with a cylinder to form a compression space. In FIG. 3, the rotary compressor flange 20 is manufactured by kneading metal powders (operation 31), pressure molding the kneaded powders at a high temperature (operation 32) and sintering the resulting sintered metal powders at a high temperature (operation 33).

Therefore, an abrasion resistance of the flange 20 made of the sintered metal is improved by performing a heat treatment. The heat treatment includes subzero treating the flange 20 at a cryogenic temperature (operation 34) and tempering the flange 20 at 100 to 120° C. (operation 35).

In the kneading operation of the metal powders 31, carbon (C) powder of 0.2 to 0.8 wt %, copper (Cu) powder of 0.5 to 4.0 wt %, nickel (Ni) powder of 1.0 wt % or less, and iron (Fe) powder are mechanically kneaded. The kneaded metal powders are compressed and molded to form the flange 20 by use of a mold and is sintered at 800 to 1200° C., thereby producing the flange 20 made of the sintered metal with a high density.

Figure 4:
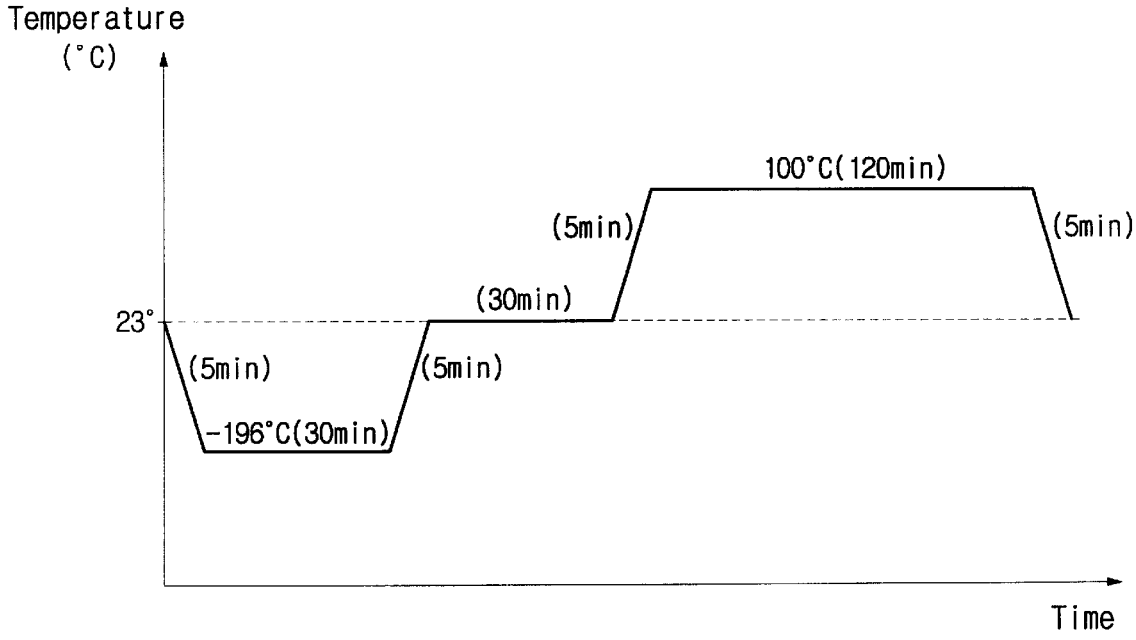
FIG. 4 is a graph showing temperature as a function of time for a heat treatment process of the sintered metal, according to an embodiment of the present invention.

During the subzero treating (operation 34), the flange 20 is quenched by dipping the flange 20 into liquid nitrogen at −196 to −200° C. for 30 minutes, as shown in FIG. 4.

The flange 20 made of the sintered metal is quenched at a cryogenic temperature of −196 to −200° C., which is much lower, for example, than a transformation temperature at which an austenite structure of the flange 20 is changed into a martensite structure. Therefore, a compression residual stress on a surface of the flange 20 made of the sintered metal is formed, thereby improving an abrasion resistance and durability of the flange 20. Furthermore, a structure of the metal is changed into an acicular structure by the subzero treatment to precipitate a copper compound (CuX), so that the abrasion resistance of the flange 20 is further improved.

After the subzero treating (operation 34), the flange 20 is subjected to tempering (operation 35). Here, the flange 20 is left alone for a predetermined time (for example about 30 minutes), then heated at 100 to 120° C., as shown in FIG. 4, so that moisture formed on the surface of the flange 20 is removed and a ductility is provided to the flange 20.

The flange 20 is heated at 100 to 120° C. for 120 minutes so that the flange 20 has some ductility, as well as a high abrasion resistance after tempering by providing the compression residual stress formed through the subzero treatment. When the temperature is too high or the heating time is too long, the compression residual stress is removed, and thus the abrasion resistance of the flange 20 is reduced. Therefore, the flange 20 has ductility and abrasion resistance by heat treating the flange 20 within a proper range of conditions.

Figure 5:
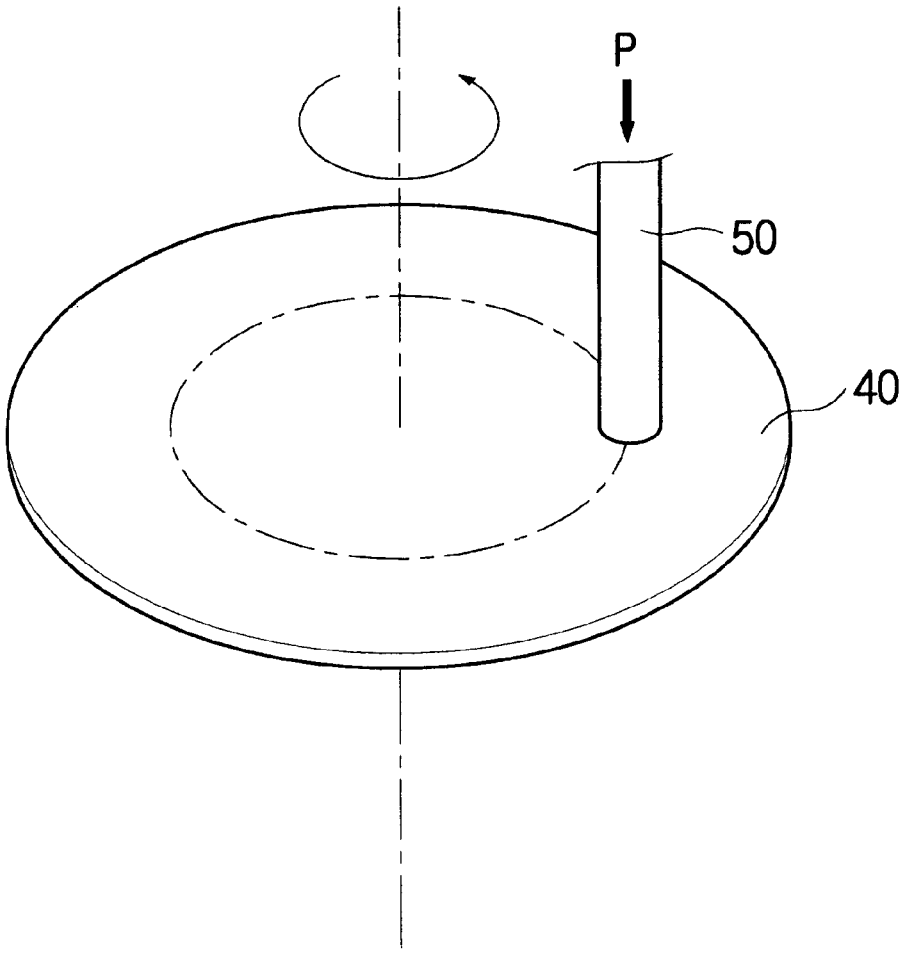
FIG. 5 is a perspective view of an experimental device to test a quantity of abraded material of the sintered metal, according to an embodiment of the present invention.

The sintered metal subjected to subzero treatment and tempering and another sintered metal produced without any heat treatment were tested for abrasion resistances with a device as shown in FIG. 5.

While a rotational plate 40 having a same material as the flange 20 was rotated at a predetermined speed by use of a separate driving device, a predetermined load was applied to a pressing specimen 50 having a same material as an eccentric rotor of a rotary shaft of a rotary compressor, which was in contact with an upper surface of the rotational plate 40. After a predetermined time, worn portions of the rotational plate 40 made of two different materials were compared. Also, to predict a quantity of abraded material of the flange 20 when the sintered metal was applied to the rotary compressor, a general lubricant used in the rotary compressor was coated on the rotational plate 40 in contact with the pressing specimen 50. The quantity of abraded material of the rotational plate 40 in contact with the pressing specimen 50 was calculated in $mm^3$.

Figure 6:
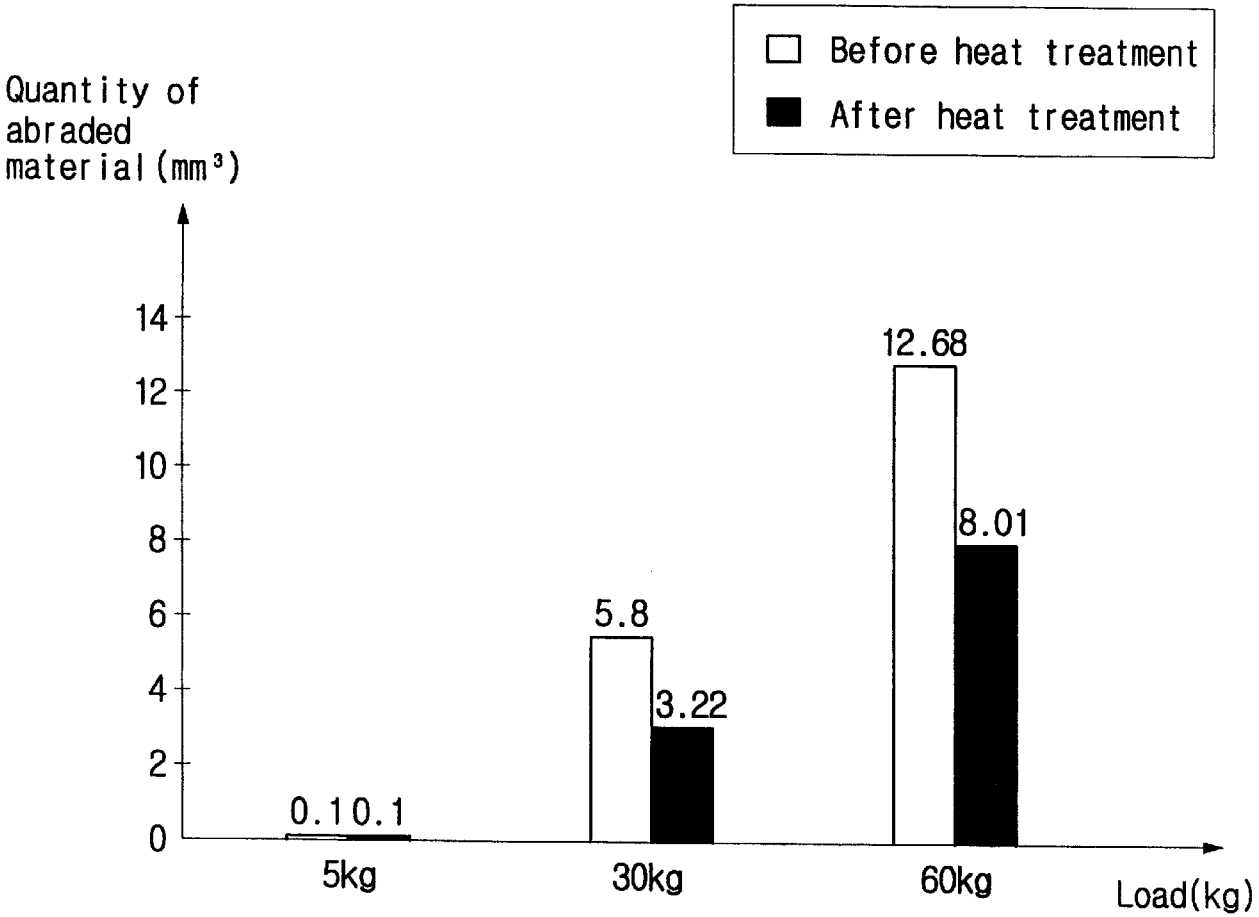
FIG. 6 is a histogram illustrating the quantities of abraded material of the sintered metal and a comparative example.

The quantity of abraded material of the rotational plate 40 was slightly differed according to different kinds of lubricant, and the sintered metal subjected to heat treatments such as subzero treatment and tempering had a much higher abrasion resistance than the sintered metal not subjected to any heat treatment (see FIG. 6).

When a load of 5 kg was applied to the pressing specimen 50 for a predetermined time, two different sintered metals had almost the same abrasion resistance. On the other hand, when a load of 30 kg was applied to the pressing specimen, the sintered metal had a level of abrasion of 3.22 $mm^3$ and the other sintered metal provided as a comparative example had a level of abrasion of 5.8 $mm^3$. When a load of 60 kg was applied to the pressing specimen, the level of abrasion of the sintered metal was 8.1 $mm^3$, and the level of abrasion of the sintered metal of the comparative example was 12.68 $mm^3$.

Therefore, the sintered metal subjected to heat treatments such as subzero treatment (operation 34) and tempering (operation 35) has a much higher abrasion resistance than the sintered metal not subjected to any heat treatment.

As described above, the sintered metal has advantages in that the sintered metal is subjected to subzero treatment and tempering to put a compression residual stress on a surface of the flange 20 made of the sintered metal and precipitate a copper compound (CuX), thereby improving an abrasion resistance and durability of the flange 20.

Although a preferred embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A method to produce a sintered metal, the method comprising:

kneading metal powder and pressure molding the kneaded metal powder;

sintering the metal powder;

subzero treating the sintered metal powder for a predetermined time; and tempering the resulting sintered metal powder under a predetermined compression residual stress.

2. The method according to claim 1, wherein said metal powder comprises carbon powder (C) of 0.2 to 0.8 wt %, copper powder (Cu) of 0.5 to 4.0 wt %, nickel powder (Ni) of 1.0 wt % or less, and iron (Fe) powder as a main component.

3. The method according to claim 1, wherein said subzero treating is conducted at −196 to −200° C.

4. The method according to claim 1, wherein said subzero treating is conducted for 30 minutes.

5. The method according to claim 1, wherein said tempering is conducted at 100 to 120° C.

6. A rotary compressor flange produced by the method according to claim 1.

7. A method to produce a rotary compressor flange made of a sintered metal, the method comprising:

kneading metal powder;

pressure molding the kneaded metal powder;

sintering the metal powder at 800 to 1200° C.;

subzero treating the sintered metal powder by quenching the flange into liquid nitrogen at −196 to −200° C. for a predetermined time;

tempering the sintered metal powder after said subzero treating, thereby improving an abrasion resistance and durability of the flange.

8. The method according to claim 7, wherein said subzero treating forms a compression residual stress on a surface of the flange to improve the abrasion resistance and durability of the flange.

9. The method according to claim 8, wherein said subzero treating changes a structure of the flange into an acicular structure to precipitate a copper compound (CuX) to improve the abrasion resistance.

10. The method according to claim 7, wherein after said tempering, the flange is placed in a stand-still state and then heated at 100 to 120° C. so that moisture formed on a surface of the flange is removed and ductility is provided thereon.

11. The method according to claim 7, using a rotational plate having a same material as the flange, and a pressing specimen to determine the abrasion resistance of the flange.

12. The method according to claim 7, wherein said subzero treating the sintered metal powder is conducted for 30 minutes.

13. The method according to claim 7, wherein the pressure molding forms the kneaded metal powder into a shape of the flange.

* * * * *